United States Patent [19]

Sekiguchi

[11] 4,356,853

[45] Nov. 2, 1982

[54] BAG

[75] Inventor: Keiji Sekiguchi, Uozu, Japan

[73] Assignee: Toyama Industry Co., Ltd., Tokyo, Japan

[21] Appl. No.: 131,832

[22] Filed: Mar. 19, 1980

[30] Foreign Application Priority Data

May 10, 1979 [JP] Japan ..... 54/62471[U]

[51] Int. Cl.[3] ..... B65D 33/00

[52] U.S. Cl. ..... 150/1

[58] Field of Search ..... 150/1, 3, 12, 0.5

[56] References Cited

U.S. PATENT DOCUMENTS

| | | | |
|---|---|---|---|
| 2,504,124 | 4/1950 | Hicks | 150/1 |
| 2,602,482 | 7/1952 | Lyon | 150/1 |
| 2,730,150 | 1/1956 | Wunderwald et al. | 150/0.5 X |
| 2,808,091 | 10/1957 | Cumbler | 150/1 |
| 3,604,491 | 9/1971 | Spiess | 150/1 X |
| 3,961,655 | 6/1976 | Nattrass et al. | 150/1 |
| 4,010,784 | 3/1977 | Nattrass et al. | 150/1 |
| 4,143,796 | 3/1979 | Williamson et al. | 150/1 X |
| 4,211,266 | 7/1980 | Massey | 150/1 |
| 4,221,250 | 9/1980 | Manerba | 150/1 X |

*Primary Examiner*—Donald F. Norton

*Attorney, Agent, or Firm*—Burgess, Ryan and Wayne

[57] ABSTRACT

A bag for free flowing powders or granules has a cylindrical body portion of a bag proper, top and bottom end portion which close top and bottom openings of the bag proper, and a cylindrical filling portion formed on the top end portion. Top edges of the cylindrical bag proper are sewn along a line passing through a point of a central axis of the cylindrical filling portion. The above-mentioned bag is made from a sheet-like cloth or a tube fabric.

2 Claims, 7 Drawing Figures

BAG

BACKGROUND OF THE INVENTION (1) Field of the Invention

The present invention relates to bags for use in storing and transporting bulk materials, such as free-flowing powders and granules, farms produce and such like and a process for manufacturing such bags. More particularly, the present invention relates to an improved bag having a material filling opening formed in the top portion thereof and a process for manufacturing this bag.

(2) Description of the Prior Art

In known bags having an opening for filling, formed in the top portion thereof, the filling opening and a top end cover are separately formed and sewn together, and the top end cover is then sewn to a bag proper. Accordingly, known bags have the defect that the sewing operation thereof is very troublesome and the efficiency of the sewing operation is very low.

Furthermore, the top end cover of the known bag is sewn to the bag proper along the entire length thereof to form a seam. As a result, the known bags have an additional defect in that this seam can be broken or loosened by an impact or shock imposed during the operation of piling or loading the bags for storage or transportation. Accordingly, from the viewpoint of carrying out the piling and loading operations without encountering this defect, it has been desired to improve the quality of these bags.

SUMMARY OF THE INVENTION

It is a primary object of the present invention to provide a practical bag in which the above-mentioned defects involved in the conventional bags are eliminated and an economical process for manufacturing such a bag.

In accordance with the present invention, there is provided a bag for use in storing and transporting a bulk material, having a cylindrical body portion of the bag proper, top and bottom end portions which close top and bottom openings of said bag proper, a cylindrical portion providing an opening for filling the bag and formed in the central portion of said top end portion, a plurality of hanging slings sewn to said bag body portion at predetermined positions adjacent to said top end portion, wherein said top end portion is formed integrally with said bag proper and sutured by a seam formed along a line passing through a central line in the longitudinal direction of said bag. The cylindrical portion for filling material may be formed of a material different from the material of the bag proper and sewn to the top end cover at the center thereof.

Another aspect the present invention provides a process for manufacturing a bag comprising a cylindrical body portion of the bag proper, top end and bottom end portions which close top and bottom openings of said bag proper, a cylindrical portion providing an opening for filling material formed in the central portion of said top end portion, comprising a first step of creating a cylindrical body corresponding to said bag proper provided with a pair of upper projections, having an identical shape and dimensions, projected from the upper edge portion thereof at two symmetrical positions with regard to the central axis of said cylindrical body, a second step of closing a bottom opening of said cylindrical body with said bottom end cover by sewing it to the bottom edge of said cylindrical body, a third step of superimposing said upper projections whereby said upper edge portion of said cylindrical body is divided into two edge portions capable of being superimposed on each other so that two L-shaped superimposed edge portions are symmetrically created with respect to the longitudinal center line of said superimposed upper projections, a fourth step of sewing said pair of L-shaped superimposed edge portions.

Accordingly, in preparing a bag according to the present invention, the sewing operation is conducted only for connecting the edge of the top end portion to the material charging cylindrical portion formed by cutting off the excess portions along L-shaped lines. Therefore, the sewing operation is simplified and is performed at a high efficiency compared with that of the known bags. Furthermore, in this case, since the portion for filling is formed integrally with the bag proper, the operation of charging a material into the bag from a top filling opening of the charging cylindrical portion can be performed very smoothly and the final bag is excellent in its adaptability to the charging operation.

The above described process for the preparation of bags may be applied not only to the above-mentioned case where a sheet-like fabric material is used but also to the case where a tubular woven fabric forward by a circular loom or the like is used as the starting fabric material.

DETAILED DESCRIPTION OF THE PREFERRED EMBODIMENTS

For the sake of a better understanding the present invention, a known bag for transporting powder, granules, etc., will first be described before the present invention is explained.

Figure 1:
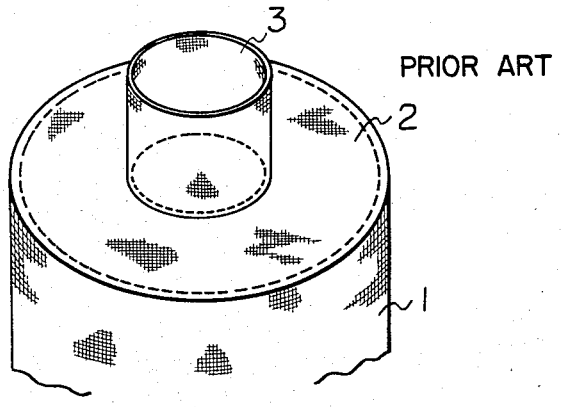
FIG. 1 is a perspective view of a part (top portion) of a conventional bag, including a material filling opening.

As illustrated in FIG. 1, a conventional bag comprises a bag proper 1 having a cylindrical form when a bulk material is filled therein, end portions in the top and bottom (not illustrated in FIG. 1), and a cylindrical portion 3 for filling material formed in the central portion of the top end portion 2 of the bag proper 1. The top end portion 2 is sewn to the cylindrical bag proper 1 along the circular edge thereof, and the cylindrical portion 3 is sewn to the top end portion 2 as illustrated in FIG. 1. Accordingly, as pointed out hereinbefore, these seams formed by such sewing operation, especially the seam between the top end portion 2 and the cylindrical bag proper 1, are poor in strength, and problems of breaking and loosening of the seams arise owing to their insufficient strength when the bag is put into practical use. Moreover, the manufacturing process is intricate because of the required complicated sewing operation, and this results in a low efficiency of the sewing operation and a high manufacturing cost. Elimination of these defects has been strongly desired in the art.

The bag of the present invention, will now be described in detail with reference to the embodiments illustrated in the accompanying drawings.

Figure 3:
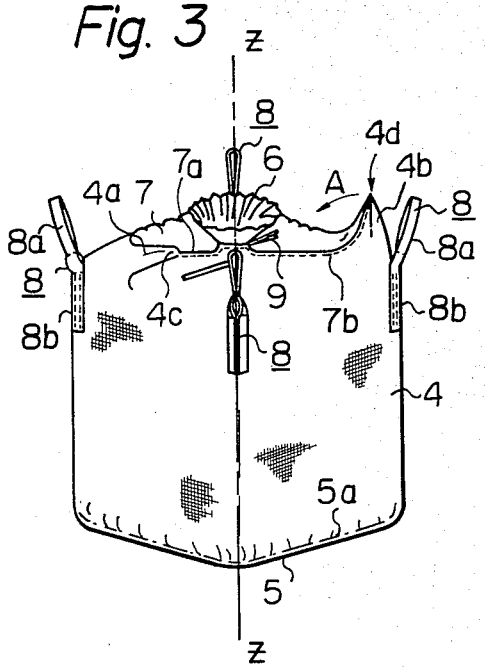
FIG. 3 is a perspective view illustrating diagrammatically the bag shown in the photograph of FIG. 2.
Figure 4:
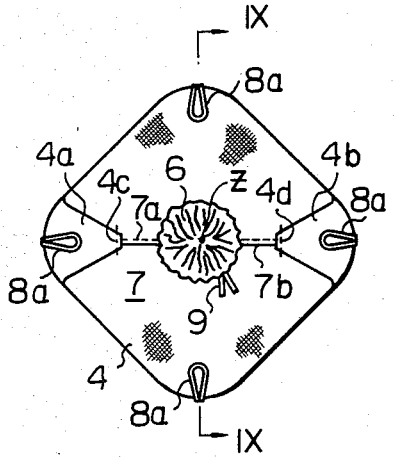
FIG. 4 is a plan view illustrating diagrammatically the bag illustrated in FIG. 3.
Figure 2:
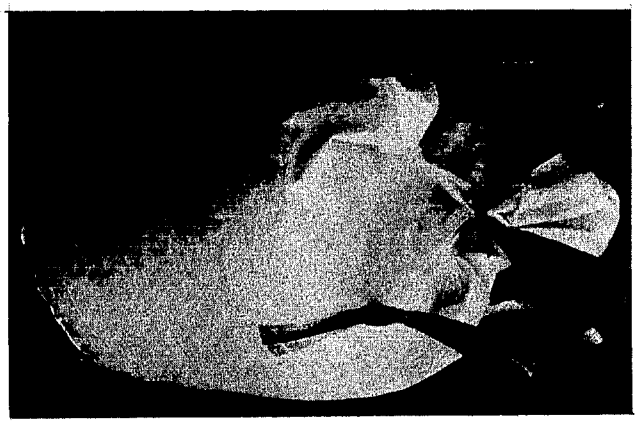
FIG. 2 is a photograph illustrating one embodiment of the bag according to the present invention, in a condition wherein the bag is filled with a material.

The bag of the present invention, illustrated in FIGS. 2, 3 and 4, comprises a cylindrical bag proper 4, a bottom end portion 5 sewn to the bottom of the bag proper 4 along a seam 5*a* and four hanging slings 8 mounted at symmetrical positions on the upper side-face of the bag proper 4. In the top portion of the bag proper 4, a cylindrical portion 6 for filling the bag with material is formed integrally with the bag proper 4 around the central line Z—Z(axis) in the longitudinal direction of the bag, and the cylindrical portion 6 is sewn through seams 7*a* and 7*b*, so that a top end portion 7 is formed integrally with the bag proper 4. The seams 7*a* and 7*b* are located symmetrically with each other with respect to the central line Z—Z(axis) in the longitudinal direction of the bag proper 4. In the embodiment illustrated in FIGS. 2, 3 and 4, a reinforcing effect is attained by folding inwardly selvages 4*a* and 4*b* of the bag proper 4, and sewing them to the corresponding seams 7*a* and 7*b* through seams 4*c* and 4*d*, respectively.

In the embodiment illustrated in FIGS. 2, 3 and 4, the bottom end portion 5 is sewn to the bag proper 4. According to experiments conducted by the inventors of the present invention, the bottom portion of the bag with the above-mentioned seam has a sufficient strength with regard to any expected forces which would be imparted to this portion during practical use. Therefore, the remaining problem to attain the purpose of the present invention concerns the construction of the top end portion 7. If a sufficient reinforcing effect can be created in this top end portion 7, there can be provided a bag having good strength which is sufficient to resist various operations. In this regard, since the top end portion 7 is integrated with the bag proper 4 through the seams 7*a* and 7*b*, which are symmetrical with each other with respect to the center of the top end portion 7, the top end portion 7 has much greater strength than the top end portion of the conventional bag illustrated in FIG. 1. Moreover, since the selvages 4*a* and 4*b* are inwardly folded and sewn to the seams 7*a* and 7*b*, the strength of the top end portion 7 is further increased.

In the above-mentioned embodiment, after a bulk material has been filled in the bag, the cylindrical portion 6 is closed by means of a tying tape 9 around the cylindrical portion 6.

Figure 5:
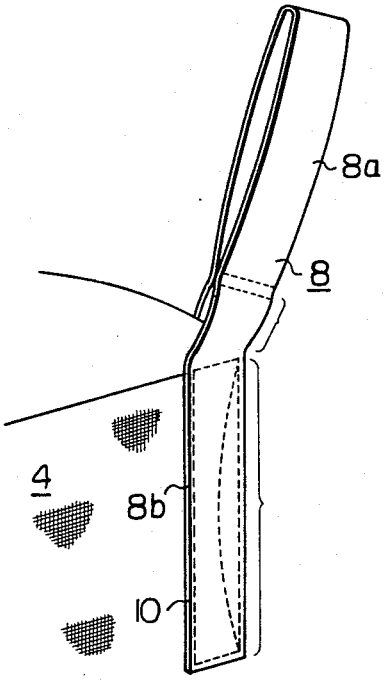
FIG. 5 is a perspective view illustrating diagrammatically a hanging sling adopted in the bag illustrated in FIG. 3.

As illustrated in FIGS. 3, 4 and 5, the hanging sling 8 adopted in the above-mentioned embodiment comprises a base 8*b* sewn to the bag proper 4 through a seam 10 at the above-mentioned predetermined position adjacent to the top end portion 7 of the bag proper 4 and an upper loopy hanging portion 8*a*. The base 8*b* has an appropriate length extending along the central line in the longitudinal direction of the bag proper 4 toward the bottom end portion 5. From the viewpoint of the strength of the bag, the length of the base 8*b* of the hanging sling 8 need not always be such that the base 8*b* is extended to the bottom end portion 5. This hanging sling 8 is disclosed in detail in Japanese Utility Model Application Laid-Open Specification No. 50670/78. Accordingly, a detailed explanation of the hanging sling is omitted here.

Figure 6:
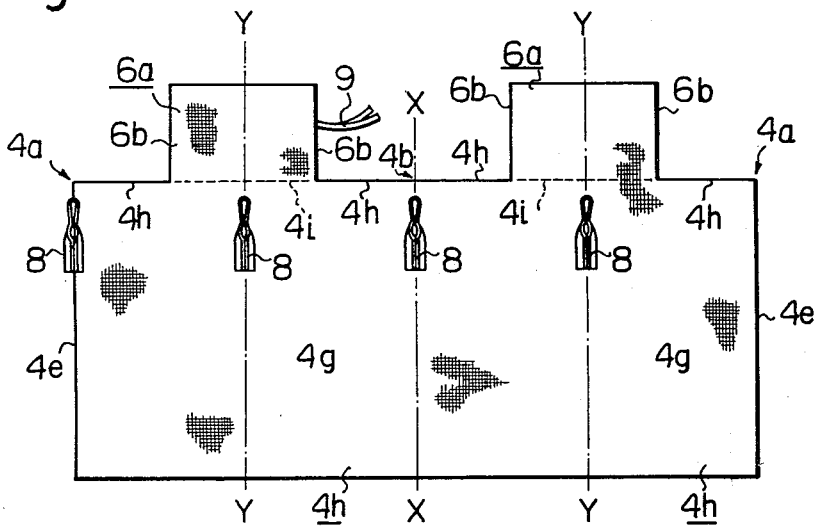
FIG. 6 is a development diagram illustrating the bag in FIG. 4, exclusive of the bottom end portion, taken in the longitudinal direction along the line IX—IX in FIG. 4.
Figure 7:
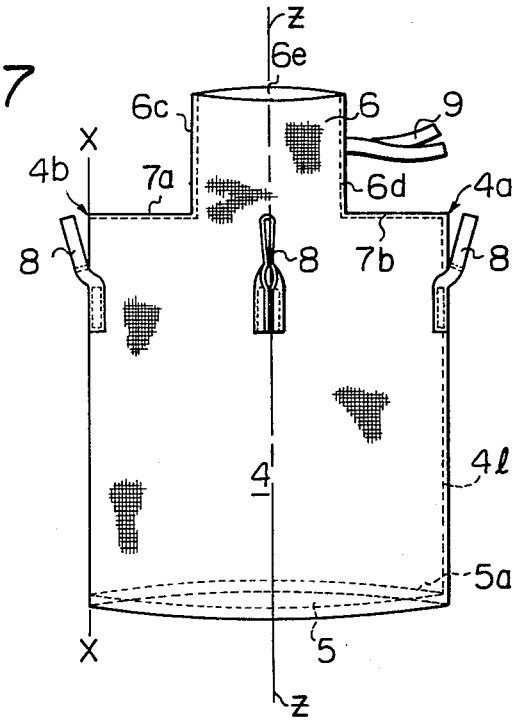
FIG. 7 is a front view illustrating diagrammatically the state wherein a material fabric cut in the shape illustrated in FIG. 6 is folded and sewn at predetermined positions.

FIGS. 6 and 7 illustrate a process for manufacturing a bag of the present invention from one sheet-like fabric material. According to the process illustrated in FIGS. 6 and 7, a bag can be made very efficiently by carrying out the following steps of cutting a starting fabric, attaching hanging slings and sewing the fabric into a bag.

(a) A starting fabric is cut to make a cut material provided with a shape and dimensions which are identical to a piece of fabric made by the following operation.

A bag is cut along the line IX—IX in FIG. 4, and the resulting two unit fabrics, exclusive of a portion corresponding to the bottom end portion 5, are connected, so as to create a one piece fabric as illustrated in FIG. 6. Therefore, the connecting line of the above-mentioned two unit fabrics corresponds to the line X—X in FIG. 6. The cut material has a shape and dimensions which are identical to the above-mentioned one piece of fabric illustrated in FIG. 6. As illustrated in FIG. 6, the left and right unit fabrics 4*g* are symmetrical with each other with respect to the line X—X. Moreover, each of the unit fabrics 4*g* is symmetrical with respect to the central line Y—Y in the longitudinal direction. A projecting portion 6*a*, for forming the cylindrical portion 6 (see FIGS. 3 and 4) for filling the bag with a bulk material, is formed integrally with each unit fabric 4*g* above the upper edge 4*h* of the unit fabric 4*g*, corresponding to the bag proper 4 of the bag, by the cutting operation.

(b) Then, four hanging slings 8 are sewn to predetermined positions of the unit fabrics 4*g*. As pointed out hereinbefore, these predetermined positions are symmetrical with respect to the central line in the longitudinal direction of the bag in the sewn and completed state as illustrated in FIG. 4. At this step, a tying tape 9 is sewn to the side edge of one projecting portion 6*a*.

(c) The unit fabrics 4*g* are folded along the line X—X as illustrated in FIG. 7 and both side edges 4*e* are superimposed with each other and sewn together along a seam 4*l* (FIG. 7) to form a bag proper 4 having a cylindrical shape.

(d) The bottom of the bag proper 4 is tightly sewn to a bottom end portion 5 having a square shape (in the embodiment illustrated in FIGS. 3 and 4), along a seam 5*a* to form a bottom portion of the bag.

(e) Then, the superimposed upper edges of the body portions 4*g* and the superimposed side edges 6*b* of the projecting portions 6*a* are sewn together along seams 7*a* and 7*b* and seams 6*c* and 6*d*, respectively, to form an opening 6*e* for filling the bag with material as a top opening of the cylindrical portion 6.

A bag as illustrated in FIGS. 3 and 4 is made by the above-mentioned cutting and sewing operations. As pointed out hereinbefore, according to this manufacturing process, the top end portion 7 of the bag can be formed very simply and assuredly.

In the above-mentioned embodiment, the projecting portions 6*a* and body portions 4*g* are integrally cut from one sheet-like fabric material. In the present invention, the projecting portions may be formed of a material softer than the material of the body portions 4*g*. In this case, the operation of closing the opening of the cylindrical portion for filling bulk material by a tape 9, after filling of a bulk material, can be facilitated. Accordingly, an embodiment in which a projecting portion 6a formed of a material different from the material of the body portion 4g is sewn to the body portion 4g along a line 4i, connecting the upper edges of the body portion 4g is included in the scope of the present invention, and the intended object of the present invention can also be attained effectively by this embodiment. More specifically, is this embodiment rectangular body portions 4g (see FIG. 6) are cut from a first material for the bag proper, and projecting portions 6a are cut from a second material. These portions 4g and 6a are then sewn along imaginary lines 4i to obtain a cut fabric with substantially the same shape as the cut fabric shown in FIG. 6. Accordingly, if the sewing operation is then carried out according to the process explained hereinbefore with reference to FIGS. 6 and 7, an intended bag can be formed.

In each of the above-mentioned embodiments of the process for manufacturing the bags according to the present invention, a sheet-like fabric material is employed as the starting material. If a tubular woven fabric or cylindrical material is used as the starting material for production of bags, the preparation process is further simplified, and since there is no seam extending in the lengthwise direction in the bag proper 44 of the resulting bag, the strength of the resulting bag is further improved. In such a case, the following process is effective for attaining the object of the present invention.

A tubular woven fabric or cylindrical material, such as a laminated tubular woven fabric or synthetic resin tube, having the same circumferential dimension as that of the body portion of the desired bag, is prepared. The fabric or material is flattened into a similar condition to that wherein two sheet-like material pieces are superimposed on each other. Then, the flattened material is cut in a shape resembling the shape of the body portion 4g illustrated in FIG. 6. More specifically, the cylindrical material is cut to a length corresponding to the length of the unit sheet fabric along the line Y—Y and, as indicated in FIG. 6, the excess upper portions on both the sides of the top end cover are cut off along L-shaped lines while leaving the portion corresponding to the upper cylindrical portion for filling the bulk material. Then, the sewing operation is carried out so as to form the top end portion and the upper cylindrical portion for filling material in the same manner as described hereinbefore with respect to the first embodiment, whereby an intended bag can be prepared very efficiently. In this embodiment, the operation of sewing the hanging slings 8 to the bag proper 4 is performed prior to formation of seams 7a, 7b, 6c and 6d.

The material constituting the bag of the present invention is appropriately chosen depending on the kind of a bulk material to be charged. Ordinarily, sheet-like plain woven fabric and tubular woven fabrics composed of flat yarns of a synthetic resin, such as polyethylene or polypropylene, or products obtained by laminating these fabrics with a synthetic rubber or resin are preferably employed. Moreover, a cylindrical film of a synthetic resin can be used.

As will be apparent from the above-descriptions, the most characteristic feature of the present invention resides in the manufacturing process, in that since a cylindrical portion is projected upwardly from the bag proper and the top opening of this cylindrical portion is used as an opening for filling a bulk material, excess portions corresponding to the portions on both the sides of this cylindrical portion above the top end portion are cut off along L-shaped lines from the material-fabric and the remaining portion is sewn so that the edge of the top end portion is formed. By virtue of this characteristic feature, in the present invention, the cylindrical portion provided with an opening for filling a bulk material and the top end portion are formed integrally with the bag proper, and the sewing operation can be remarkably simplified because sewing of the entire circumference of the top end portion with the bag proper, which is indispensable in the conventional technique, can be omitted.

Accordingly, the strength of the bag of the present invention is much higher than the strength of the conventional bags, and therefore, the bag of the present invention is very advantageous in that accidents due to the breaking or splitting of the bag can be effectively eliminated. Moreover, since the cylindrical portion provided with an opening for filling a bulk material is integrally formed with the bag proper, the bag of the present invention has a very good shape-retaining property and the operation of filling a bulk material therein can be performed very smoothly. These are the prominent advantages attained by at least preferred embodiments of the present invention.

I claim:

1. In a bag for use in storing and transporting a bulk material, having a cylindrical body portion with an axis, a bottom end portion which closes the bottom opening of said cylindrical body, a top end portion having an opening for filling the bag in the central portion of said top end portion about the axis, a plurality of handling slings sewn to said bag body at predetermined positions adjacent to said top end portion the improvement which comprises; a top end portion formed integrally with said cylindrical body portion, having a cylindrical portion for filling the bag having an opening smaller than the cylindrical body portion and sutured by a seam formed along a plane of the axis of said cylindrical body portion wherein said cylindrical body portion is provided with a pair of selvages formed at both end portions of said seam for said top end portion, said selvages folded inwardly and sewn to said seam.

2. A bag according to claim 1, wherein the number of said hanging slings is four and two of said hanging slings are each sewn to said bag proper at a respective position adjacent to a corresponding one of said selvages, while the other two hanging slings are sewn to said bag proper at the respective central positions between said selvages, said central positions being symmetrical with respect to said seam for closing said top end portion.

* * * * *